US005290038A

United States Patent [19]

Khin

[11] Patent Number: 5,290,038

[45] Date of Patent: Mar. 1, 1994

[54] PREDATOR SIMULATION BOARD GAME APPARATUS

[76] Inventor: Houn S. Khin, P.O. Box 690160, Stockton, Calif. 95269

[21] Appl. No.: 959,643

[22] Filed: Oct. 13, 1992

[51] Int. Cl.[5] ..... A63F 3/00

[52] U.S. Cl. ..... 273/263; 273/238; 273/282.1

[58] Field of Search ..... 273/236, 237, 238, 263, 273/282 R, 282.1, 288

[56] References Cited

U.S. PATENT DOCUMENTS

| | | | |
|---|---|---|---|
| 970,993 | 9/1910 | Colomb | 273/263 |
| 1,321,405 | 11/1919 | Suyehiro | 273/263 |
| 1,554,022 | 9/1925 | Nelson | 273/263 |

FOREIGN PATENT DOCUMENTS

| | | | |
|---|---|---|---|
| 1168603 | 12/1958 | France | 273/263 |
| 243366 | 7/1946 | Switzerland | 273/263 |
| 8506 | of 1908 | United Kingdom | 273/263 |

OTHER PUBLICATIONS

"Predator-prey simulation game", Mandell et al., Classroom Ideas, *The Science Teacher*, vol. 44, No. 5, p. 44.

*Primary Examiner*—William Stoll
*Attorney, Agent, or Firm*—Leon Gilden

[57] ABSTRACT

A board game is arranged to simulate inner action between a predator species, such as a tiger, and a prey species, such as a cow, wherein the predators are overwhelmingly outnumbered by the prey, and wherein the prey by various tactics is permitted to eliminate the predator, wherein the predator readily eliminating the prey by a jumping motion, wherein the game board is arranged to include intersecting game paths to permit interaction of the predator and prey tokens relative to the game paths.

2 Claims, 4 Drawing Sheets

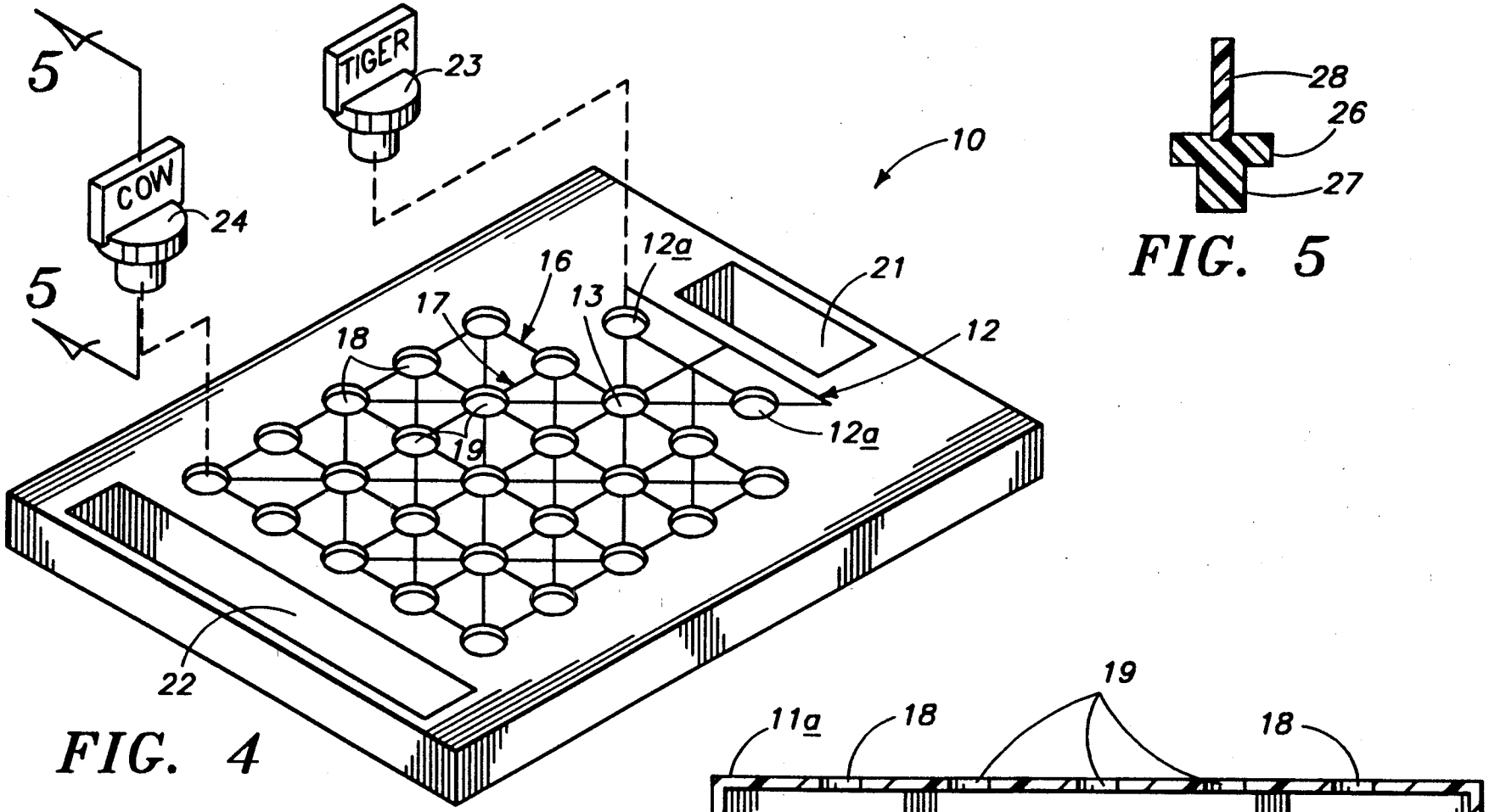
FIG. 4
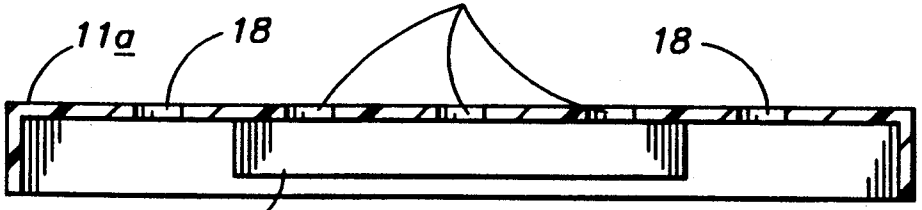
FIG. 3
FIG. 5

PREDATOR SIMULATION BOARD GAME APPARATUS

BACKGROUND OF THE INVENTION

1. Field of the Invention

The field of invention relates to game apparatus, and more particularly pertains to a new and improved predator simulation board game apparatus wherein the same is arranged to effect simulation of inner action between a predator and prey species utilizing tokens and intersecting game paths for purposes of simulation.

2. Description of the Prior Art

Board games of various types are utilized in the prior art and particularly jumping type games wherein tokens such as in a checkers method of play permits jumping of opponents such as set forth in U.S. Pat. Nos. 4,886,279; 3,434,719; 4,150,828; and 3,610,627.

Accordingly, there remains a need for a new and improved predator simulation board game apparatus as set forth by the instant invention addressing both the problems of ease of use as well as effectiveness in construction in providing for simulation of inner action between a predator and prey species utilizing simplicity of understanding and entertainment of the game structure in a manner not set forth by the prior art and in this respect, the present invention substantially fulfills this need.

SUMMARY OF THE INVENTION

In view of the foregoing disadvantages inherent in the known types of game apparatus now present in the prior art, the present invention provides a predator simulation board game apparatus wherein the same is arranged to effect simulation of inner action between a predator and a prey greatly outnumbering the predator token. As such, the general purpose of the present invention, which will be described subsequently in greater detail, is to provide a new and improved predator simulation board game apparatus which has all the advantages of the prior art game apparatus and none of the disadvantages.

To attain this, the present invention provides a board game arranged to simulate inner action between a predator species, such as a tiger, and a prey species, such as a cow, wherein the predators are overwhelmingly outnumbered by the prey, and wherein the prey by various tactics is permitted to eliminate the predator, wherein the predator readily eliminating the prey by a jumping motion, wherein the game board is arranged to include intersecting game paths to permit inner action of the predator and prey tokens relative to the game paths.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved predator simulation board game apparatus which has all the advantages of the prior art game apparatus and none of the disadvantages.

It is another object of the present invention to provide a new and improved predator simulation board game apparatus which may be easily and efficiently manufactured and marketed.

It is a further object of the present invention to provide a new and improved predator simulation board game apparatus which is of a durable and reliable construction.

An even further object of the present invention is to provide a new and improved predator simulation board game apparatus which is susceptible of a low cost of manufacture with regard to both materials and labor, and which accordingly is then susceptible of low prices of sale to the consuming public, thereby making such predator simulation board game apparatus economically available to the buying public.

Still yet another object of the present invention is to provide a new and improved predator simulation board game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 1 in the direction indicated by the arrows.

FIG. 4 is an isometric illustration of the game board structure cooperating with representative tokens.

FIG. 5 is an orthographic view, taken along the lines 5—5 of FIG. 4 in the direction indicated by the arrows.

DESCRIPTION OF THE PREFERRED EMBODIMENT

Figure 1:
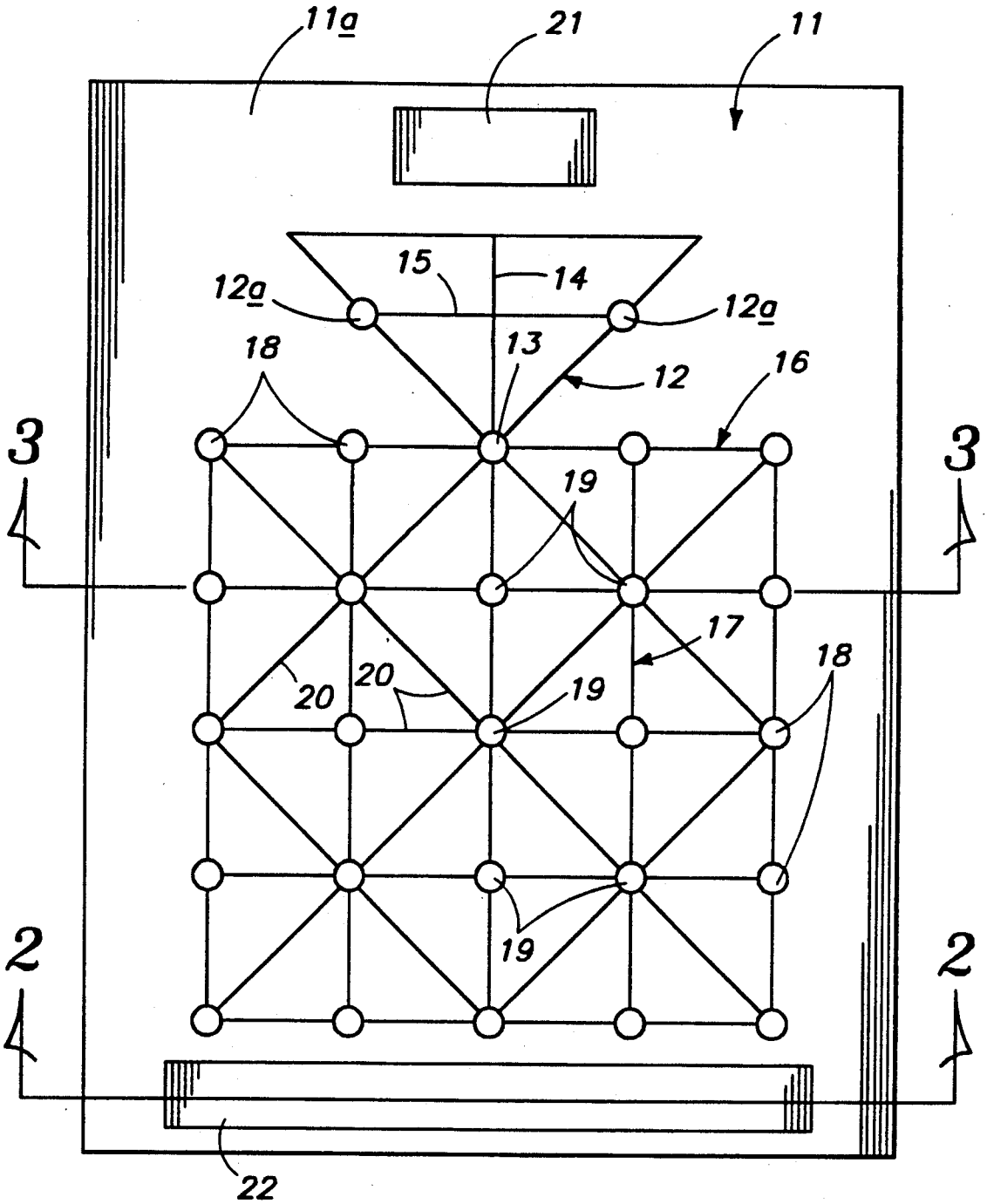
FIG. 1 is a top orthographic view of the game board of the invention.
Figure 2:
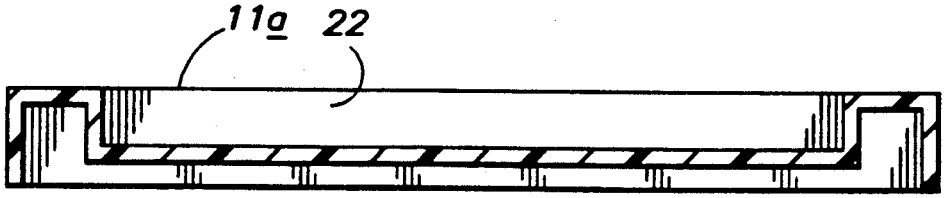
FIG. 2 is an orthographic view, taken along the lines 2—2 of FIG. 1 in the direction indicated by the arrows.
Figures 6, 7:
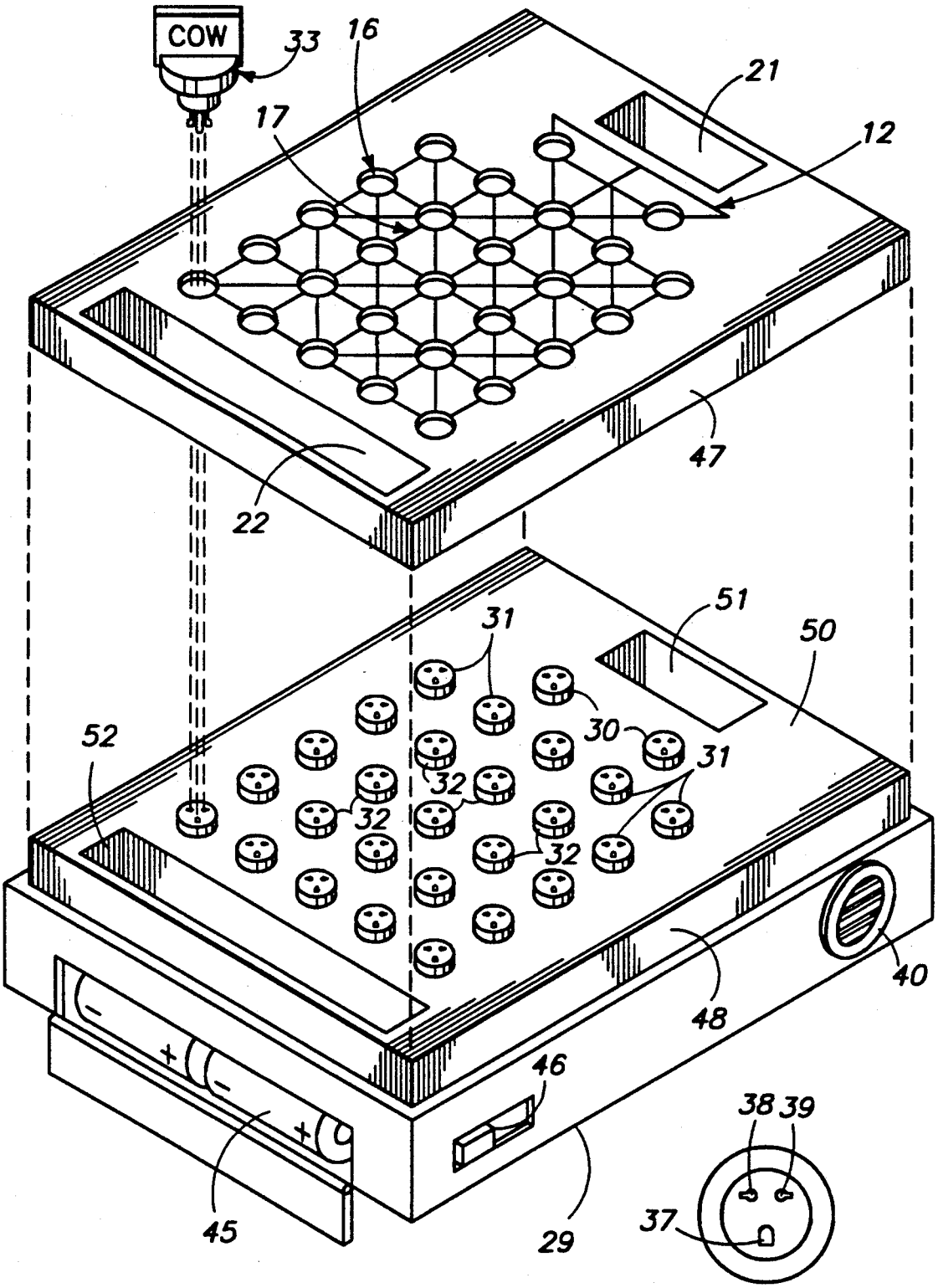
FIG. 6 is an isometric illustration of the invention employing sound reproduction structure in association with the game board as directed through the game board.
FIG. 7 is an orthographic top view of a representative plug member utilized by the invention, as set forth in FIG. 6.
Figure 8:
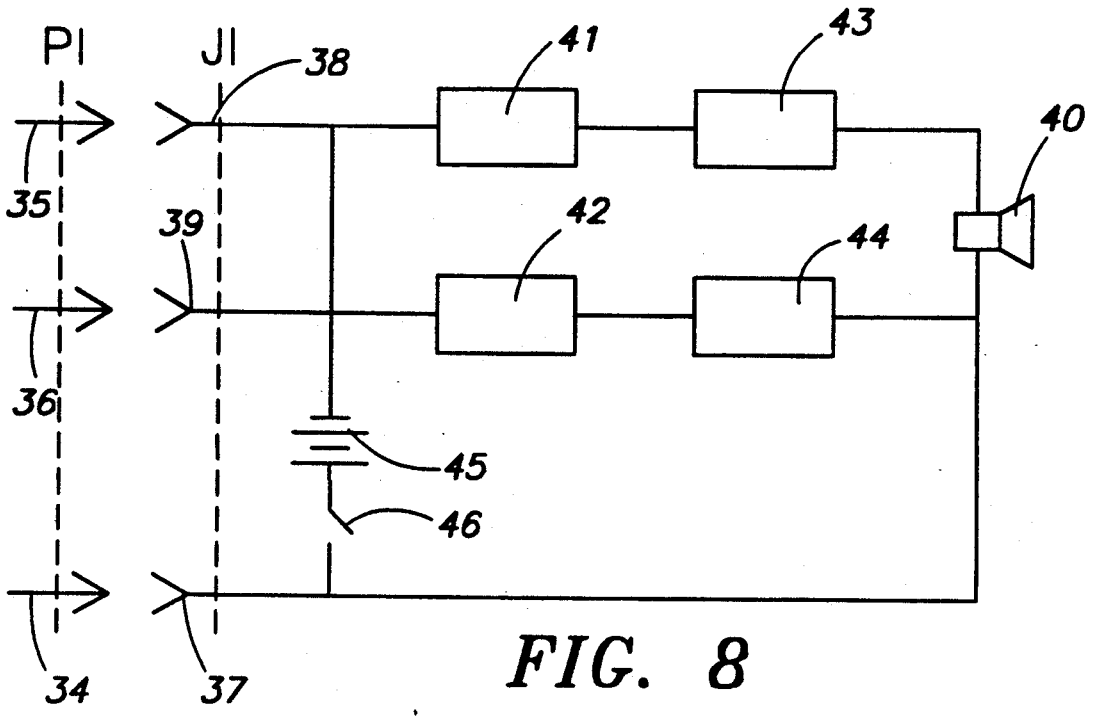
FIG. 8 is a diagrammatic electrical illustration of cooperation of the tokens and the bosses of the invention.
Figure 9:
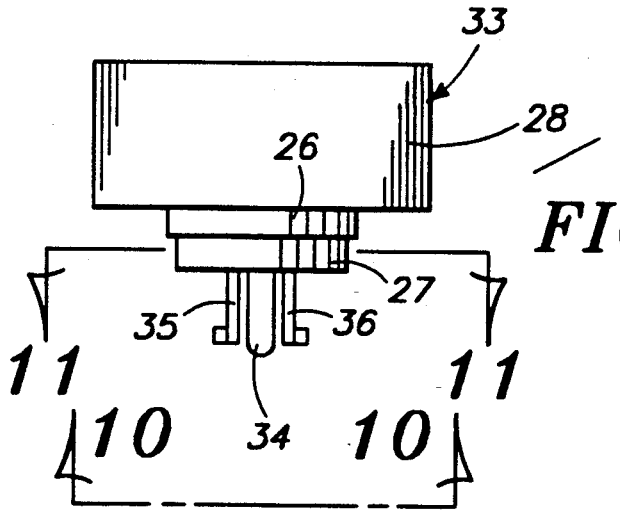
FIG. 9 is an orthographic side view of a modified token member of the invention, of a type such as indicated in FIG. 6.
Figure 10:
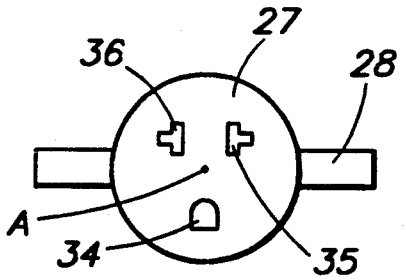
FIG. 10 is an orthographic view, taken along the lines 10—10 of FIG. 9 in the direction indicated by the arrows.

With reference now to the drawings, and in particular to FIGS. 1 to 11 thereof, a new and improved predator simulation board game apparatus embodying the principles and concepts of the present invention and generally designated by the reference numeral 10 will be described.

More specifically, the predator simulation board game apparatus 10 of the instant invention essentially comprises a game board 11 having a game board top wall 11*a*. An equilateral triangular path 12 is arranged to intersect an outer rectilinear path 16, with the outer rectilinear path 16 having an inner rectilinear path 17. The triangular path 12 includes an apex bore 13 at an apex of the triangular path 12, with the triangular path 12 including further triangular path bores 12*a* directed through legs of the triangular path extending from the apex bore 13. The triangular path 12 further includes first and second intersecting paths 14 and 15, with the first intersecting path intersecting the base of the triangular path and the apex bore 13, with the second intersecting path 15 intersecting the first intersecting path 14, with the second intersecting path 15 further intersecting the triangular path bores 12*a*. The outer rectilinear path 16 includes outer rectilinear path bores 18, with the outer rectilinear path 16 further having the apex bore 13 colinear with a plurality of the outer path bores 18, with the inner rectilinear path 17 including inner rectilinear path bores 19. The inner and outer bores 17 and 18 are equally spaced along their respective paths. Further, one of the inner rectilinear path bores 19 is oriented medially of the outer and inner rectilinear paths 16 and 17. Intersecting paths 20 are arranged to intersect the outer and inner bores 18 and 19, as well as the further inner bore 19 medially of the inner rectilinear path 17. The various intersecting paths 14, 15, and 20 permit movement of tokens (of a type to be discussed in more detail below) between the various bores of the various paths. A first token pocket 21 is directed into the game board top wall 11*a* at a first end thereof between the first end of the game board and the triangular path 12, with a second pocket 22 directed into the game board top wall 11*a* between the outer rectilinear path and a second end of the game board for supporting the plurality of categories of tokens utilized. The categories of tokens includes first and second tokens 23 and 24 respectively. Each token includes a token base 26 and a projecting boss 27. The token base projecting boss 27 (see FIG. 5) is of a predetermined diameter substantially equal to an equal predetermined diameter of each of the bores 12*a*, 13, 18, and 19. The token base 26 extends laterally beyond the projecting boss 27 to function as an abutment onto the game board top wall 11*a*. Base indicator plates 28 orthogonally and fixedly mounted to the token bases 26 permit indication of the category of token of the either predator or prey category. The predator category utilizes a first predetermined number of tokens, wherein the second predetermined number of a multiple of four to ten times that of the first predetermined number to simulate prey outnumbering predators.

In play of the game, a predator token to eliminate a prey token is merely to jump over a token along one of the paths 14, 15, 16, and 17 to an available space on an opposed side of the prey token. The prey tokens 24 may eliminate a predator by surrounding a predator such that the predator has no available avenue of escape of manner of jumping over one of the surrounding prey tokens. A player to have lost his predetermined number of tokens concedes the game to the player having available tokens remaining on the game board for play.

The FIGS. 6–11 indicate the apparatus further including sound simulation structure if desired for play to enhance entertainment and amusement in utilization of the apparatus. Specifically, a support 29 is provided having a support top wall 15 mounting a matrix of first, second, and third contact cylindrical boss plugs 30, 31, and 32 mounted fixedly thereon to be received through the respective apex and triangular path bores 13 and 12*a*, with the second boss plugs 31 received through the outer path bores 18 and the third contact boss plugs 32 received through the inner path bores 19. Modified tokens 33 are utilized, and the tokens are utilized for both the first and second categories of tokens of the types as discussed above relative to the first and second token members 23 and 24. Each of the modified tokens includes the projecting boss 27 of the modified token structure 33 having respective first, second, and third contact projections 34, 35, and 36 directed downwardly and coaxially parallel and spaced from an axis of the projecting boss 27. Each of the first, second, and third boss plugs 30, 31, and 32 includes respective first, second, and third contact receptacle bores 37, 38, and 39 to complementarily receive the first, second, and third contact projections 34, 35, and 36. In this manner, the organization is arranged to permit audible reproduction of a prey or predator message simulating the characteristic of such predator or prey species, such as a cow "moo" or a lion "roar". To this end, an audio speaker 40 is provided and mounted through the support 29, with a respective first and second switching relay 41 and 42 in electrical communication with respective first and second audio reproduction devices 43 and 44 to simulate respective predator and prey sounds for example. A battery structure 45 is provided operative through an on/off switch 46 to provide for electrical communication of the batteries 45 relative to the electrical organization.

Figure 11:
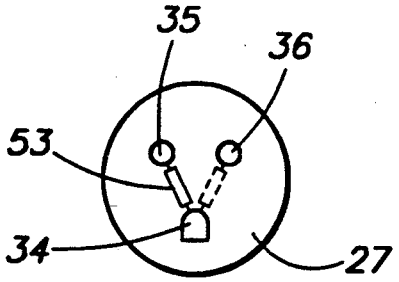
FIG. 11 is an orthographic view, taken along the lines 11—11 of FIG. 9 in the direction indicated by the arrows.

FIG. 11 notes that within each projecting boss 27, a switching leg 53 is oriented between the first contact projection 34 and selectively one of the second end third contact projections 35 and 36. In this manner, electrical communication is directed through the first or second audio reproduction devices 43 and 44 dependent upon whether the switching leg 53 is in electrical communication with the second or third contact projection 35 or 36.

The game board 11 includes a game board skirt 47 projecting orthogonally and downwardly therefrom for complementary reception upon a support boss 48 of the support 29. In this manner, the support boss top wall 49 is arranged in contiguous communication with the game board top wall 11*a* to properly align and register each of the boss plugs 30, 31, and 32 through the respective bores 12*a*, 13, 18, and 19 as indicated.

Further, the support boss top wall 15 includes a first cavity to receive the first token pocket 21 therewithin, and a second cavity 52 relative to the first cavity 51 to receive the second pocket 22 therewithin to align and register the game board 11 relative to the support 29.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A predator simulation board game apparatus, comprising, a game board having a game board top wall, with a first path of triangular configuration directed along the game board top wall and having a triangular path apex bore, and a second path configured as an outer rectilinear path directed along the game board top wall, and an inner rectilinear path positioned medially within the outer rectilinear path directed along the game board top wall, wherein the triangular path intersects the outer rectilinear path at the apex bore, with the outer rectilinear path having outer path bores directed into the game board through the outer path, and the inner path including inner path bores directed through the inner rectilinear path through the game board top wall, and the outer rectilinear path and the inner rectilinear path including intersecting paths directed between the outer path and the inner path intersecting the outer path bores and the inner path bores, and first tokens mounted on the first path and second tokens mounted on the second path for interaction on the game board, and a first predetermined number of first tokens are provided, and a further predetermined number of second tokens are provided, with the further first predetermined number equal to a multiple of four to ten times the predetermined number, and the first tokens include a token base having a base diameter and a projecting boss coaxially aligned with the token base having a second diameter, wherein the second diameter is less than the first diameter, and a base indicator plate fixedly mounted to the token base extending from the token base, and a support member, the support member having a support member boss, and the support member boss having a support boss top wall, and the support boss arranged for complementarily receiving the game board thereon for contiguous communication of the support boss top wall with the game board top wall, and the support boss top wall includes a matrix of boss plugs, wherein each of the boss plugs is directed through one of said triangular path bores, apex bore, inner path bores, and outer path bores, and each of the first and second tokens includes a respective first, second, and third contact projection extending from each projecting boss and directed downwardly therefrom, and each boss plug includes respective first, second, and third contact receptacle bores for reception of the respective first, second, and third contact projections to effect registration of each projecting boss with one of said boss plugs.

2. An apparatus as set forth in claim 1 wherein the support includes a speaker member, and a switch member, and at least one battery member, and a first audio reproduction device, and a second audio reproduction device, wherein the first audio reproduction device is in electrical communication with the second contact receptacle bore and the second audio reproduction device is in electrical communication with the third contact receptacle bore, and the first contact electrical bore includes a switching leg to effect selective electrical communication between the first contact projection and the second contact projection to effect selective communication between the first contact receptacle bore and one of said second contact receptacle bore and third contact receptacle bore to effect selective actuation of the respective first audio reproduction device and the second audio reproduction device when a token of said first token and second token is directed into one of said boss plugs.

* * * * *